United States Patent [19]

Pytlewski

[11] 3,966,127

[45] June 29, 1976

[54] CENTRIFUGAL DEVICE AND PROCESS FOR CONCURRENTLY RUPTURING AND PULVERIZING GRANULAR MATERIAL, PARTICULARLY CEREAL GRAIN

[75] Inventor: Steve Pytlewski, Rodom, Poland

[73] Assignees: Raymond Pytlewski, Torrance; Theodore Pytlewski, Woodland Hills, both of Calif. ; part interest to each

[22] Filed: Nov. 1, 1974

[21] Appl. No.: 519,880

[52] U.S. Cl. ..... 241/73; 241/86.1

[51] Int. Cl.[2] ..... B02C 13/06

[58] Field of Search ..... 241/84, 86, 86.1, 88.4, 241/89.2, 91, 51, 55, 73, 79.2

[56] References Cited

UNITED STATES PATENTS

| | | | |
|---|---|---|---|
| 1,571,408 | 2/1926 | Guelbaum | 241/91 X |
| 1,788,686 | 1/1931 | Mott | 241/55 X |
| 1,945,054 | 1/1934 | MacGregor et al. | 241/51 |
| 2,246,902 | 6/1941 | Smith | 241/91 |
| 2,505,023 | 4/1950 | Williamson | 241/86 X |
| 2,517,990 | 8/1950 | Dressel | 241/86.1 |
| 2,587,372 | 2/1952 | Oliver | 241/89.2 |
| 2,640,650 | 6/1953 | Jacobson | 241/89.2 |
| 3,057,564 | 10/1962 | Bridgewater | 241/91 |
| 3,169,711 | 2/1965 | Helms | 241/86 X |

*Primary Examiner*—Granville Y. Custer, Jr.
*Attorney, Agent, or Firm*—Howard L. Johnson

[57] ABSTRACT

Method and apparatus which combines centrifugal and rotary-abrasive forces for rupturing air-carried granular material, such as cereal grain, which is then reduced to a desired (variable) screen size or powder. Such product may be as finely pulverized as flour or may simply consist of mixed grains which are reduced to a uniform particle size suitable for pelletized animal feed. Inorganic material such as particles of talc, clay, kaolins, earth pigments, etc. can be similarly processed. Power driven, hollow, cylindrical rotor has circumferential series of axially directed, radial outlets which permit easy passage therethrough of the axial granular flowstream to a surrounding channel or raceway formed by a tubular screen spaced radially outward from the rotor outlets. Preferably the fixed screen is interchangeable with others of different mesh and is disposed eccentric to the rotor so as to define a closed, fixed path for the ruptured granules which converges lengthwise so as to progressively constrict the rotating body of ruptured particles against the screen face and thus increase its abrasive action. The inner face of the hollow rotor has inward projecting fins or baffles disposed adjacent the following edges of the outlets, thus producing or augmenting the centrifugal outflow.

6 Claims, 3 Drawing Figures

CENTRIFUGAL DEVICE AND PROCESS FOR CONCURRENTLY RUPTURING AND PULVERIZING GRANULAR MATERIAL, PARTICULARLY CEREAL GRAIN

BACKGROUND OF THE INVENTION

Anciently, particulate material such as minerals or cereal grain were reduced in size manually by use of mortar and pestle, and in larger quantities (and with additional power such as from animals or water wheel) by a rotating abrasive or grinding stone. In modern times, steel rollers have replaced abrasive wheels in flour milling, banks of progressively closer set rollers crushing the grain, which after removal of bran and germ portions by sifting, is recycled and bleached to produce white flour. Modern nutritional objection to such sterile and storage-stable product is based on this total removal of all bran, vitamins and wheat germ. However, rather than trying to "reconstitute" the inert flour with synthetic vitamins added at some point, it would be preferable to grind whole grain wheat — without separation of midlings — at least to the extent that such product could be used in the immediate future and hence without the addition of synthetic preservatives and other unnatural contaminants or "fortifying agents".

While the theoretical application of centrifugal force has been suggested for milling, its practical application has remained elusive, since merely hurling a stream of grain against a surface with sufficient force to shatter the granules does not of itself produce a product of any uniformity; its further handling is a continuing problem and the equipment proposed for this so far has not been inviting.

Accordingly it is a purpose to now provide a comparatively simple device which can be provided in small scale for home use, or alternately can be set up on large scale for commercial milling, which in a single step (or at least concurrently) can produce grain flour (not necessarily limited to wheat) without removal of any components from the whole grain. Alternately, such device can also be used to produce "white" flour, if desired, of any fineness, from grain from which the bran and germ has been removed.

BRIEF STATEMENT OF THE INVENTION

The present process employs a rotary or whirling force typified by a cyclone chamber which impells a stream of air-suspended grain or other particulate material, centrifugally against an adjacent or encircling perforate wall or screen, which force simultaneously frictionally moves the thus ruptured particles against the perforate or apertured wall until they are sufficiently reduced in size to pass through such screen of selected mesh. The whole process can be effected as a unitary procedure, with a continuous flow pattern, the fineness of the resulting flour being variable simply by substitution of another mesh tubular screen inserted in the housing, spaced outward from the surrounded cyclone impellor or rotor.

Structurally the invention provides a hollow, cylindrical rotor having a circumferential series of axially directed openings of a size enabling the ready passage of granular feed material there through, the following edge of the openings having inward-directed fins or baffles which permit or promote the centrifugal fluid flow. Surrounding the rotor and spaced radially outward therefrom is a tubular, apertured member or screen which is removably retained in edge-insertion grooves of a housing, the encircling walls of which are spaced outward from the tubular screen to define a powder collection chamber with a delivery outlet leading therefrom. Gaseous (air) suspension of granular material is admitted to the center of the hollow rotor at a rate (correlated with the speed of rotation) adapted to keep the rotor cavity substantially less than half full, such flow rate at the same time maintaining the raceway (which lies between the rotor and tubular screen) fully occupied by the rotating body of ruptured granules.

Preferably the tubular screen is mounted eccentric to the enclosed rotor, thereby making the intervening rotary channel or raceway characterized by a progressively transversely constricted thickness which, as it approaches the minimum width, compacts the body of ruptured granules against the screen or apertured surface. As compared with an annular raceway (as provided by a concentrically mounted screen) this small and unobvious change may increase the rate of flour production by as much as 50 percent.

In such structural assembly, three factors (each of which may be deliberately varied) influence or change the fineness or size of the final product—

1. mesh or screen size—which can be varied by interchangeability of the tubular screens;
2. radial displacement of the screen from the outer face of the rotor—in general, increased fineness of the powder or flour is achieved by moving the screen closer to the rotor face;
3. without changing the preceding factors, the rate of throughput can be greatly increased, as noted above, simply by mounting the screen eccentric to the rotor. This result can be obtained by merely using a somewhat elliptical shaped (tubular) screen.

BRIEF DESCRIPTION OF THE DRAWINGS

The invention is illustrated by reference to a portable family-size assembly which is adapted to "grind" or process whole cereal grain, without separation of bran and germ components. However grain from which such elements have been removed, as well as inorganic granules, can also be processed in such unit.

Figure 1:
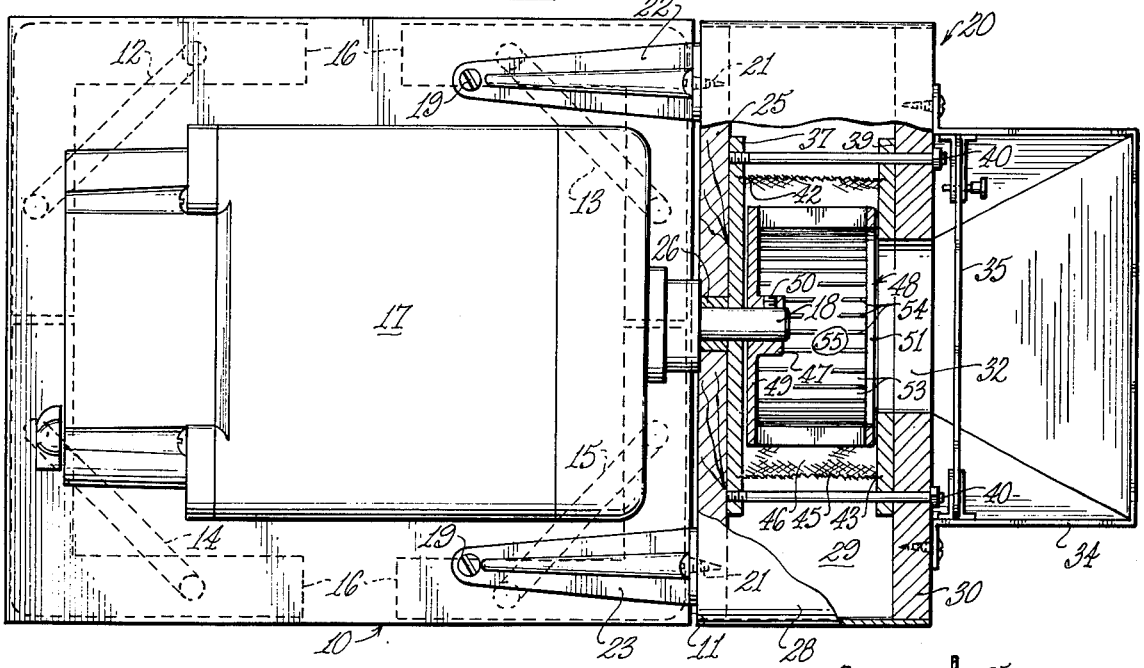
FIG. 1 is a top plan view of the assembly including an electric motor, with most of the processing unit shown in horizontal section.
Figure 2:
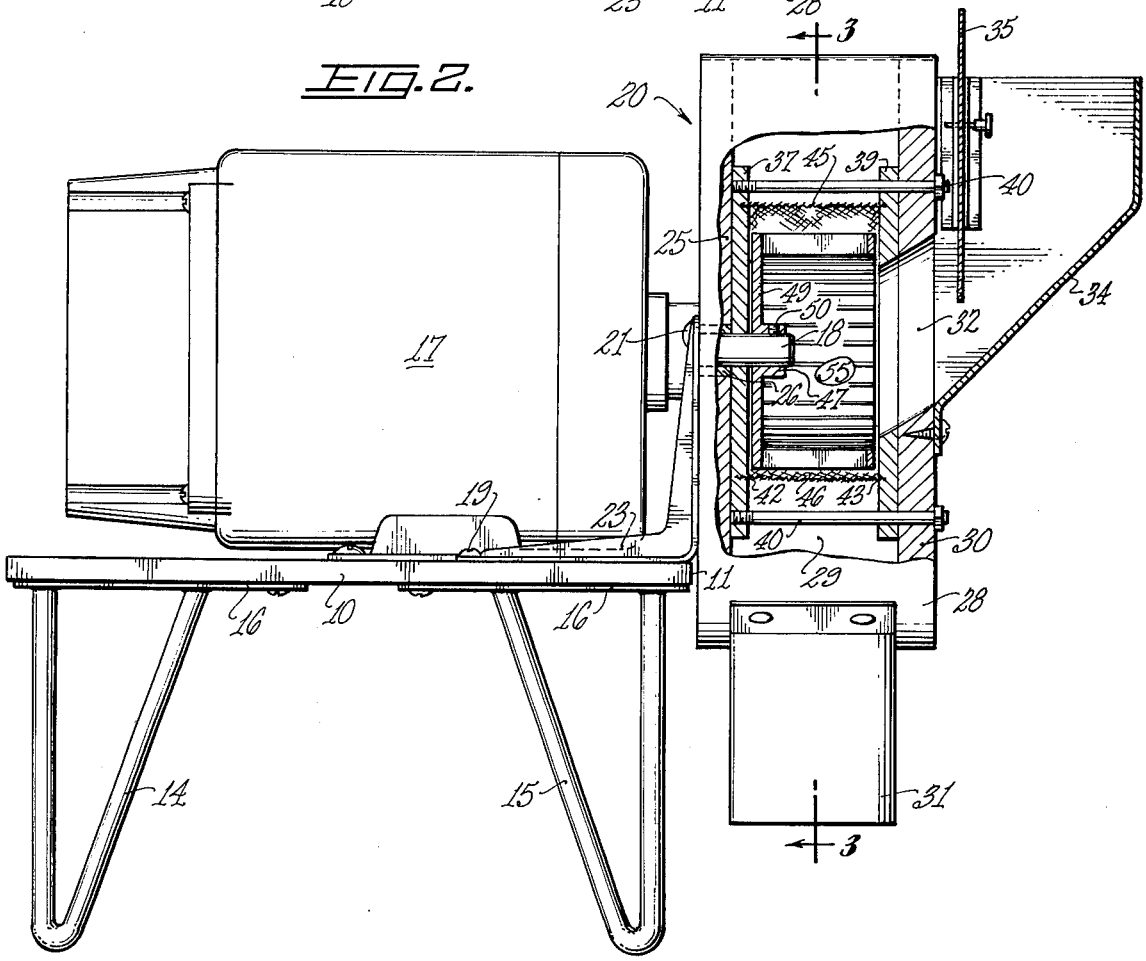
FIG. 2 is a side elevational view of the assembly, with the processing unit seen in vertical section.

The compact embodiment of the invention here illustrated is mounted on a relatively small, horizontally disposed, generally rectangular pallet or platform 10 which can be placed flat on a shelf or table top, or alternately disposed thereabove by suitable support elements such as the four V-shaped legs 12, 13, 14, 15 extending downward from horizontal L-shaped attachment plates 16 secured to the underface of the pallet. An electric motor 17 or other rotary power source (including, as the simplest form, a hand crank and sufficient gear train to maintain high speed rotation of the drive shaft) is attached to the pallet with its horizontal drive shaft 18 extending centrally beyond a transverse end 11 of the pallet and spaced thereabove.

A generally rectangular, upright housing 20 is secured against the end wall 11 by a parallel pair of L-shaped brackets 22, 23, which are upstanding from the top face of the panel adjacent longitudinal edges thereof, being secured to the pallet by screws 19 and to the disc-shaped rear wall 25 of the housing by respective screws 21. The housing wall 25 is apertured for retension of a bearing sleeve 26 which journals a traversing length of the drive shaft 18 as it projects therebeyond into the housing chamber.

It will be seen that the lower segment of the disc-shaped wall 25 extends below the pallet, and secured thereto, extending forward from its peripheral margin is a circumferential wall 28 which together with a forward end wall or disc-shaped face 30 defines an internal drum-shaped housing cavity 29 having a dependent outlet channel or conduit 31. The face wall 30 is centrally apertured at 32 to receive the feed flow from a delivery hopper 34, such flow being regulated by (manual) positioning of a slidable, vertically disposed gate valve or plate 35.

Generally centered within the chamber 29 are a pair of axially spaced plates 37, 39 of smaller diameter than the drum walls 25, 30, the inner plate 37 being secured against the inner face of the rear housing wall 25 and providing threaded sockets for a circle of bolts 40 which are terminally inserted therein after successively passing through the face disk 30 and outer plate 39. The latter two disks may also be attached to each other face to face so that they may be removed from the encircling cylindrical housing 28 as a unit, in substituting a screen of different mesh.

Figure 3:
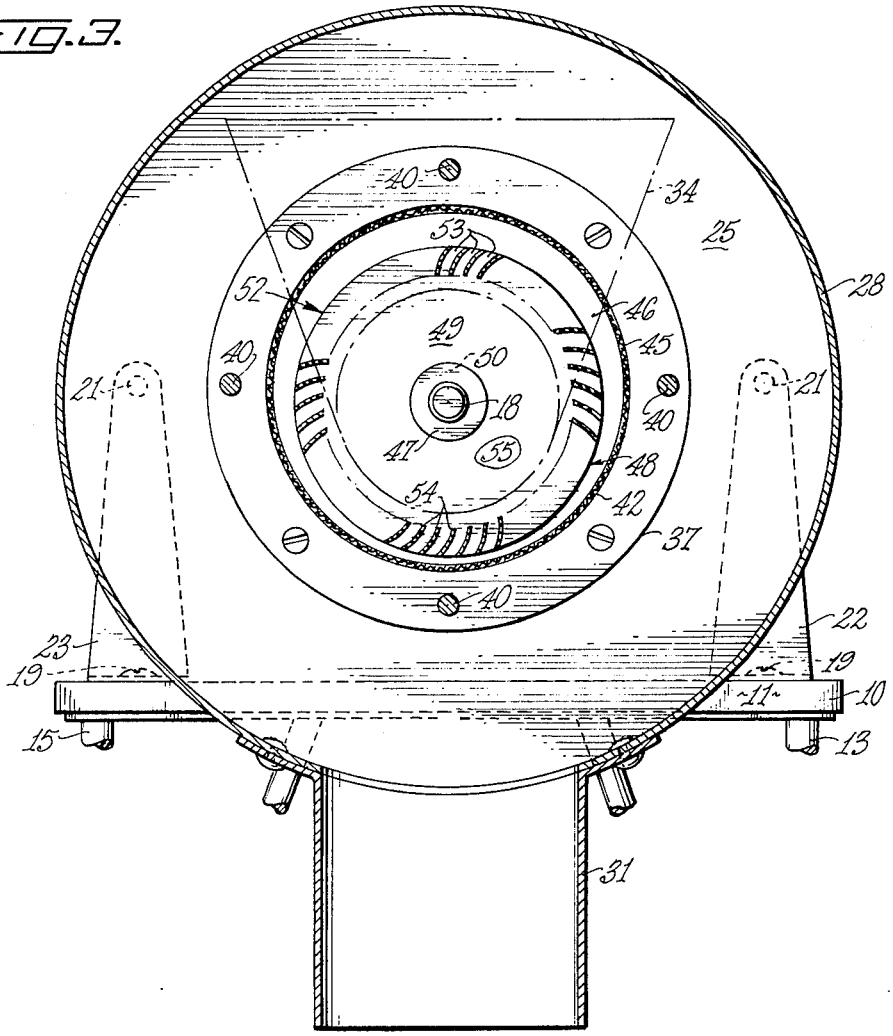
FIG. 3 is a vertical sectional view taken through the processing unit as seen along the line 3—3 of FIG. 2.

The inner, opposing faces of the two plates 37, 39 are each formed with transversely-aligned endless grooves 42, 43, which may be annular in shape but in a preferred form are more-or-less oval shaped and hence are disposed somewhat eccentric to the drive shaft 18. Lodged within the respective grooves are the corresponding edge rims of a tubular, apertured member or screen 45 of similar egg-shaped perimeter (as best seen in FIG. 3) which is thus removably retained between the plates 37, 39 so as to embrace or delineate an inner chamber 46 within the outer surrounding cylindrical housing chamber 29.

Within the screened chamber 46 is a cylindrical, hollow rotor 48 with an inward directed, central hub 47 of its rear plate 49 secured to the end of the drive shaft 18, as by a set screw 50. The outer end of the rotor is formed by an open-centered-disk 51 disposed to receive the feed stream from a hopper 34. The outer cylindrical form of the rotor is interrupted by a peripheral series of elongated, axially directed slots or apertures 52. Projecting generally radially inward along the trailing edge of each slot is a fin or baffle 54 of generally rectangular outline and a slightly concave curvature across the lead face, that is, in the direction of rotation of the rotor. It is principally the circle of inward projecting baffles that create a cyclone chamber 55 upon rapid rotation of the rotor, which action hurls the continuing stream of granules centrifugally outward through the individual apertures 53 into the generally annular chamber 46 where the granules strike the screen face 45 and (those not immediately reduced to a size passable throught the screen) form a rotating body of ruptured granules which move about this endless channel or raceway as long as the rotor continues to spin, rubbing against the screen face until the particles are sufficiently reduced in size to pass through the apertures. As long as there is some quantity of granules within the cyclone chamber 55, the raceway or channel 46 will remain filled with the revolving body of ruptured pieces. When the quantity within the cyclone chamber is exhausted, the quantity of particles within the raceway is still revolved by the rotor until it all passes through the apertures so that no incompletely reduced granules remain.

The incoming flow of air and granules drawn through the hopper delivery aperture 32 is adjusted to the speed of the rotor and is regulated so as to maintain a granular volume within the cyclone chamber 55 of no more than about 50 percent and preferably on the order of about 10 percent to about 25 percent. As this latter quantity increases, the rotor may begin to overheat, a drag appears on the drive shaft, and the voluminous flow stream seems to clog the assembly rather than easily passing through. In other words, if the rotor were theoretically stopped so as to make visible the level of granules which then settled to the bottom of the cyclone chamber, such level should not exceed the bottom edge of the hub 47 and preferably should be somewhat lower. The flow rate which results in such internal volume is set by the position of the valve plate 35.

For a constant speed motor, the plate would be retained at the same setting for like-size granules even though the granular feed might vary from one substance to another. However, for a different granule size (even though the same material, e.g. corn) the inlet aperture would be adjusted by means of the plate position. With a variable speed motor, the flow would be balanced against the speed, so as to maintain the required granular volume in the cyclone chamber.

It is estimated that approximately nine volumes of air are drawn through the unit for one volume of solid (dry) granules or feed. However this is self-regulating; that is, the air is sucked in between the individual granules which fill the hopper. For this reason especially, the assembly cannot handle sticky or agglutinated material such as sludge, or wet, tenaciously clinging material even through basically granular or in small pieces. However, in some cases the air current may pick up enough moisture from damp or moist feed as to enable the latter to pass through the assembly. It will be apparent also that the granules or pieces need not be a uniform size. And with earth or mineral material, a minor amount of powder may also be present, and will go through the assembly together with the pieces.

As an example of the operation of the illustrated home-size assembly: with a 5¾ inch diameter, concentric, 20 mesh, tubular screen (45) and a 4¾ inch rotor (48) with ½ inch wide apertures (53) driven at 5,000 RPM by a ½ HP electric motor, whole grain wheat was passed through at about 25 to about 30 lbs./hour. When the tubular screen was changed from cylindrical to one which was elliptical shaped and mounted eccentrically, as illustrated, the assembly processed about 45 lb. per hour at the same motor speed.

Although the tubular, apertured member 45 is most conveniently formed by a ready-made, sturdy, metallic (wire) screen, this may fairly readily wear out under the continuous granular impact and abrasion of the ruptured pieces, as well as from vibration. It has been found effective, alternately, to form such an apertured member (45) of a circle of radially outward directed plates having their inner ends or edges spread apart the same distance as the desired screen openings. Such plates then wear back lengthwise, as it were, and possess a much longer life.

I claim:

1. That process for rupturing granular material such as cereal grain and further reducing the ruptured granules to a desired pulvurant size in a continuous procedure, said process comprising suspending a minor volume of granular material within a gaseous flow stream and by centrifugal force effected by rapid rotation of a rotor having a cylindrical series of multiple radially-directed baffles directing said stream against a surrounding spaced surface having multiple small apertures of selected size, said stream being moved with a force adapted to rupture the grains of material by impact with said surface, but leaving at least some of them larger than capable of passing through said apertures, accumulating and maintaining a body of thus ruptured granules extending inward from said surface beyond the outer edges of the rotor baffles, and moving said granular body transversely and frictionally across said surface by repetative rotation of the baffles through said body, thereby converting said ruptured granules to a reduced size adapted to pass through the apertures of said surface.

2. The process of claim 1 wherein the radial distance between said apertured surface and the outer edges of the rotating baffles is progressively transversely constricted in thickness, thereby correspondingly compressing said intervening body against the apertured surface.

3. The process of claim 1 wherein said granular material comprises whole grain wheat.

4. A device for rupturing and pulverizing granular material which is capable of being moved by a suspending air stream, said device comprising in combination:

a tubular member having multiple small apertures of selected size which are adapted to pass an ultimate pulvurant product of desired fineness, housing means spacedly surrounding said tubular member and having outlet means adapted to deliver material from said apertures, a hollow cylindrical rotor spaced within said tubular member and characterized by a circumferential series of longitudinal openings formed between generally radially inward directed baffles, said openings being of sufficient size to allow free passage of granular material therethrough, inlet means for supplying a flowing mixture of air and granular material to the interior of said rotor and including flow control means adapted to maintain a body of said ruptured granular material extending inward from the apertured tubular member beyond the outer edges of the rotor baffles, and means for rotating said rotor sufficient to produce a centrifugal force adapted to move said granular material through the openings of the rotor and impinge against the tubular member so as to rupture the granules and thereafter to move said body in a repetative path about the internal surface of the tubular member so as to reduce the size of the ruptured granules to such size as will pass through the apertures.

5. A device according to claim 4 wherein said tubular member is disposed eccentric to the surrounded rotor, thus creating between the member and the rotor a rotary channel of periodic progressive constriction within which the ruptured granules move until further reduced to a size passable through its apertures.

6. A device according to claim 4 wherein said tubular member comprises a removable screen and said housing means is adapted for substitution of screen-members of selected mesh.

* * * * *